US011117168B2

(12) United States Patent
Nilson

(10) Patent No.: US 11,117,168 B2
(45) Date of Patent: Sep. 14, 2021

(54) SYSTEM AND METHOD FOR PROCESSING USABLE CROP INTERMIXED WITH DEBRIS

(71) Applicant: Crary Industries, Inc., West Fargo, ND (US)

(72) Inventor: Michael A. Nilson, West Fargo, ND (US)

(73) Assignee: Crary Industries, Inc., West Fargo, ND (US)

( * ) Notice: Subject to any disclaimer, the term of this patent is extended or adjusted under 35 U.S.C. 154(b) by 205 days.

(21) Appl. No.: 16/278,395

(22) Filed: Feb. 18, 2019

(65) Prior Publication Data

US 2019/0255572 A1 Aug. 22, 2019

Related U.S. Application Data

(60) Provisional application No. 62/633,183, filed on Feb. 21, 2018.

(51) Int. Cl.

| | |
|---|---|
| ***B07B 9/00*** | (2006.01) |
| ***B07B 4/08*** | (2006.01) |
| ***B07B 1/14*** | (2006.01) |

(52) U.S. Cl.

CPC ..... *B07B 9/00* (2013.01); *B07B 1/14* (2013.01); *B07B 4/08* (2013.01)

(58) Field of Classification Search

CPC .... B07B 9/00; B07B 1/14; B07B 4/08; B07B 1/185; B65G 21/14

USPC ..... 209/420, 667, 34, 421, 412, 405, 413

See application file for complete search history.

(56) References Cited

U.S. PATENT DOCUMENTS 7,165,628 B2 * 1/2007 Taylor ..... A01D 19/04 171/112

2008/0223765 A1 * 9/2008 Dees ..... B07B 1/005 209/404

FOREIGN PATENT DOCUMENTS

WO WO-2008051408 A2 * 5/2008 ..... E02F 5/226

OTHER PUBLICATIONS

Office Action dated Apr. 22, 2020 in Canadian Patent Application No. 3,034,488.

* cited by examiner

*Primary Examiner* — Charles A Fox
*Assistant Examiner* — Molly K Devine
(74) *Attorney, Agent, or Firm* — Wood, Phillips, Katz, Clark & Mortimer

(57) ABSTRACT

A system for processing usable crop intermixed with debris and having a frame with a conveying system thereon. The conveying system has a first debris separating assembly with a first subframe having a plurality of cooperating rollers that are configured to cause separation of debris from the usable crop. A second debris separating assembly, different than the first debris separating assembly, has a second subframe with a plurality of cooperating rollers thereon that are configured to cause separation of debris from the usable crop. The frame and first and second debris separating assemblies are configured as overall like modules so that the first and second debris separating assemblies can be separately operatively connected, one in place of the other, on the frame.

20 Claims, 9 Drawing Sheets

SYSTEM AND METHOD FOR PROCESSING USABLE CROP INTERMIXED WITH DEBRIS

BACKGROUND OF THE INVENTION

Field of the Invention

This invention relates to crop processing and, more particularly, to a system and method for conveying usable crop in a processing path and progressively separating debris intermixed with the usable crop as the usable crop is advanced.

Background Art

It is common to process usable crop intermixed with debris by conveying the usable crop in a processing path along which debris is progressively separated. Existing systems commonly have different stages at which the debris is separated in different manners.

It is well known to use, in one of the stages, a cleaning table that consists of a plurality of cooperating rollers that engage a mixture of usable crop and debris attached thereto. The rollers interact to separate loose soil, clods, stones/rocks, vines, etc. from the usable crop. The rollers on the cleaning tables are designed to aggressively break loose a majority of the above types of debris while at the same time not bruising the usable crop.

To accomplish these objectives, which are generally competing, cleaning tables are made with different constructions to adapt to different crop types and different soil conditions. System designers must take into account different types of soils, the presence of stones and rocks of different size, different soil consistency impacted by climate, field location, changing weather patterns, both long and short range, etc. There is no known universal cleaning table design that effectively removes all types of debris, and all types of soil, from different crops. Ineffective debris separation may necessitate subsequent manual debris separation and transportation and ultimate handling of potentially a large volume of heavy debris. Accordingly, the cleaning tables are commonly customized to a particular field operation.

With the relevant technology in its current state, those processing crops have essentially two alternatives when it comes to selection of the construction of the cleaning tables. One option is to select a cleaning table design that has the most generic application for all crop types and soil conditions. Efficiency and effectiveness of separation, while preserving crop integrity, may be compromised with this option, particularly as field conditions and crop type vary.

The second option is to reconfigure the cleaning table before the start of a field operation. This can be a relatively complex operation which may require a relatively high level of skill and a component-by-component disassembly and reconstruction. The end user may not have the mechanical skill level to reconfigure the equipment on site, and thus may engage outside personnel to effect the cleaning table reconfiguration. As a result, the entire system may be taken out of commission while an appropriate reconfiguration takes place. For even a skilled person, this may be a relatively lengthy process. During harvesting season, these interruptions in operation can be highly costly in terms of efficiency and may result in significant losses in the event that harvesting cannot be efficiently completed, or completed at all, as in the event of extreme changes in weather conditions.

This latter option may be impractical when an operator is faced with changing conditions, from one field to the next, that may be encountered in a single day and/or that may change abruptly in the course of a given day, as when heavy precipitation occurs.

Since reconfiguration of the cleaning tables has heretofore been relatively complicated and time consuming, most will avoid multiple reconfigurations of the cleaning tables, or reconfiguration at all, to minimize downtime and minimize the need for skilled labor to effect the reconfiguration. While this may lead to a loss of efficiency, there is also a possibility that the cleaning table might become clogged or jammed, depending upon the particular field and weather conditions, which could significantly disrupt processing operations, potentially multiple times in a given day, as cleaning of equipment is carried out.

Because of the limitations of the existing technology in this industry, those processing crops continue to contend with the above problems to this day.

SUMMARY OF THE INVENTION

In one form, the invention is directed to a system for processing usable crop intermixed with debris. The system includes at least one frame and a conveying system on the at least one frame configured to convey usable crop in a processing path between upstream and downstream locations. The conveying system has a first debris separating assembly with a first subframe having a plurality of cooperating rollers therein that are configured to: a) engage usable crop intermixed with debris traveling between the upstream and downstream locations; and b) cooperate to cause separation of debris from the usable crop. The conveying system has a second debris separating assembly with a second subframe having a plurality of cooperating rollers thereon that are configured to: a) engage usable crop intermixed with debris traveling between the upstream and downstream locations; and b) cooperate to cause separation of debris from the usable crop. The first debris separating assembly has a configuration different than a configuration of the second debris separating assembly. The at least one frame and first and second debris separating assemblies are configured so that the first and second debris separating assemblies can be separately operatively connected, one in place of the other, on the at least one frame.

In one form, the conveying system includes at least a first conveying section upstream of the operatively connected first or second debris separating assembly and a second conveying section downstream of the operatively connected first or second debris separating assembly. The first conveying section is configured to convey usable crop intermixed with debris in a portion of the processing path to the operatively connected first or second debris separating assembly. The second conveying section is configured to convey usable crop in a portion of the processing path away from the operatively connected first or second debris separating assembly.

In one form, at least one of the rollers in the plurality of cooperating rollers on each of the first and second debris separating assemblies is a driven roller.

In one form, first and second rollers in the plurality of cooperating rollers on each of the first and second debris separating assemblies are each driven rollers.

In one form, a total number of the rollers on the first debris separating assembly is different than a total number of the rollers on the second debris separating assembly.

In one form, the rollers on the first and second debris separating assemblies each has a peripheral outer surface to engage conveying usable crop. A configuration of the peripheral outer surface of one of the rollers on the first debris separating assembly is different than a configuration of the peripheral outer surface of any of the rollers on the second debris separating assembly.

In one form, the at least one frame defines a discrete receptacle with a vertical depth into which the operatively connected first or second debris separating assembly is placed.

In one form, the at least one frame has a plurality of discrete, spaced mounting pads each configured to bear upon a part of the operatively connected first or second debris separating assembly.

In one form, each of the first and second subframes has first and second walls at which opposite ends of the rollers on the respective subframe are supported. The rollers on each of the first and second operatively connected debris separating assemblies have axes that are transverse to the processing path.

In one form, the first and second walls on each of the first and second subframes are spanned by a plurality of connecting components whereby the first and second walls and connecting components on each of the first and second subframes define a fixed, unitary construction that supports respective rollers.

In one form, the system for processing usable crop intermixed with debris further includes a plurality of releasable fasteners through which the operatively connected first or second debris separating assembly is secured to the at least one frame.

In one form, the system includes a drive for at least one of the rollers on the operatively connected first or second debris separating assembly.

In one form, there is an hydraulic drive on each of the first and second debris separating assemblies for at least one of the rollers on a respective debris separating assembly and a source of pressurized hydraulic fluid on the at least one frame for operating the hydraulic drive on the operatively connected first or second debris separating assembly.

In one form, the hydraulic fluid is communicated from the source of pressurized hydraulic fluid to the hydraulic drives through conduit lines. There are quick connect fittings on the conduit lines connecting between the source of pressurized hydraulic fluid and the hydraulic drives on the first and second debris separating assemblies to facilitate interchanging of the first and second debris separating assemblies.

In one form, there are a plurality of lifting fittings on each of the first and second subframes to facilitate lifting and handling of each of the first and second subframes.

In one form, the invention is directed to a method of processing usable crop intermixed with debris. The method includes the steps of: obtaining the system described above wherein the first and second debris separating assemblies have different configurations selected to process usable crop intermixed with debris with different types or conditions of soil in which the usable crop is planted and/or different usable crop; with the first debris separating assembly operatively connected, unearthing the usable crop from the soil and processing the usable crop and intermixed debris by conveying the usable crop and intermixed debris in the processing path including to the first debris separating assembly at which intermixed debris is separated from the usable crop; separating the first debris separating assembly from the at least one frame; operatively connecting the second debris separating assembly; and with the second debris separating assembly operatively connected, unearthing additional usable crop from the soil and processing the additional usable crop and intermixed debris by conveying the usable crop and intermixed debris in the processing path including to the second debris separating assembly at which intermixed debris is separated from the usable crop.

In one form, the method further includes the step of obtaining one of a hoist or a crane and using the hoist or crane to vertically lift the operatively connected first debris separating assembly as a unit away from the at least one frame and to lower the second debris separating assembly as a unit to against the at least one frame to a position wherein the second debris separating assembly can be operatively connected to the at least one frame.

In one form, the method further includes the step of analyzing a condition of the soil in which the usable crop is planted and selecting one of the first and second debris separating assemblies that is configured to better process the usable crop intermixed with debris than the other of the first and second debris separating assemblies.

In one form, the step of operatively connecting the second debris separating assembly includes securing the second debris separating assembly to the at least one frame using threaded fasteners.

In one form, an hydraulic drive is provided on each of the first and second debris separating assemblies for at least one of the rollers on a respective debris separating assembly. A source of pressurized hydraulic fluid is provided on the at least one frame. The hydraulic fluid is communicated to the hydraulic drive through conduit lines. The method further includes the steps of: using quick connect fittings on the conduit lines to facilitate separation of the operatively connected first and second debris separating assemblies from the at least one frame; and operative connection of each selected first and second debris separating assembly to the at least one frame.

DETAILED DESCRIPTION OF THE PREFERRED EMBODIMENT

Figure 1:
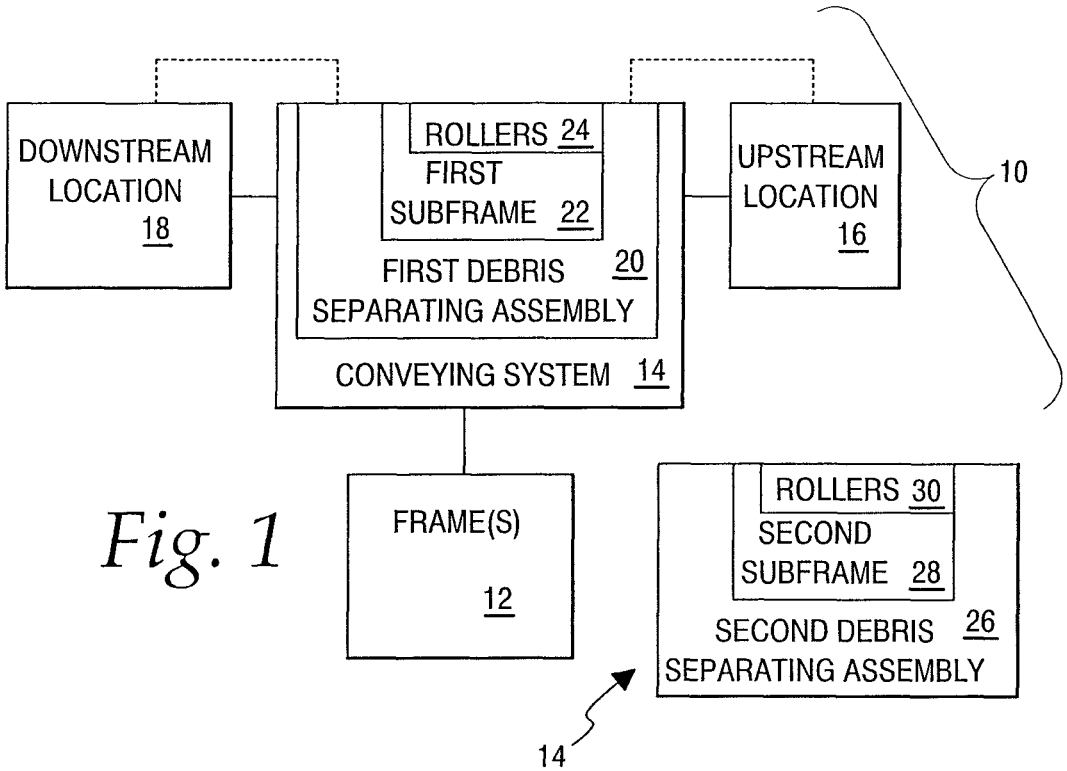
FIG. 1 is a schematic representation of a system for processing usable crop intermixed with debris, according to the invention, and including a conveying system with interchangeable debris separating assemblies that convey usable crop through at least part of a crop processing path between upstream and downstream locations.

In FIG. 1, a schematic representation of a system for processing usable crop intermixed with debris, according to the present invention, is depicted at 10.

The system 10 has at least one frame 12 on which a conveying system 14 is provided. The conveying system 14 is configured to convey usable crop in a processing path between upstream and downstream locations 16, 18, respectively.

The conveying system 14 has a first debris separating assembly 20 with a first subframe 22 having a plurality of cooperating rollers 24 thereon that are configured to: a) engage usable crop intermixed with debris traveling between the upstream and downstream locations 16, 18; and b) cooperate to cause separation of debris from the usable crop.

The conveying system 14 further has a second debris separating assembly 26 with a second subframe 28 having a plurality of cooperating rollers 30 thereon that are configured to: a) engage usable crop intermixed with debris traveling between the upstream and downstream locations 16, 18; and b) cooperate to cause separation of debris from the usable crop.

The first debris separating assembly 20 has a configuration that is different than a configuration of the second debris separating assembly 26.

The at least one frame 12 and first and second debris separating assemblies 20, 26 are configured so that the first and second debris separating assemblies 20, 26 can be separately operatively connected, one in place of the other, on the at least one frame 12.

Figure 2:
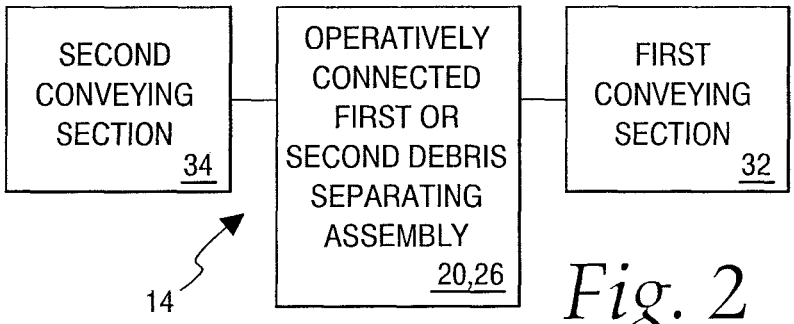
FIG. 2 is a schematic representation of the conveying system of FIG. 1 in relationship to upstream and downstream conveying sections.
Figure 3:
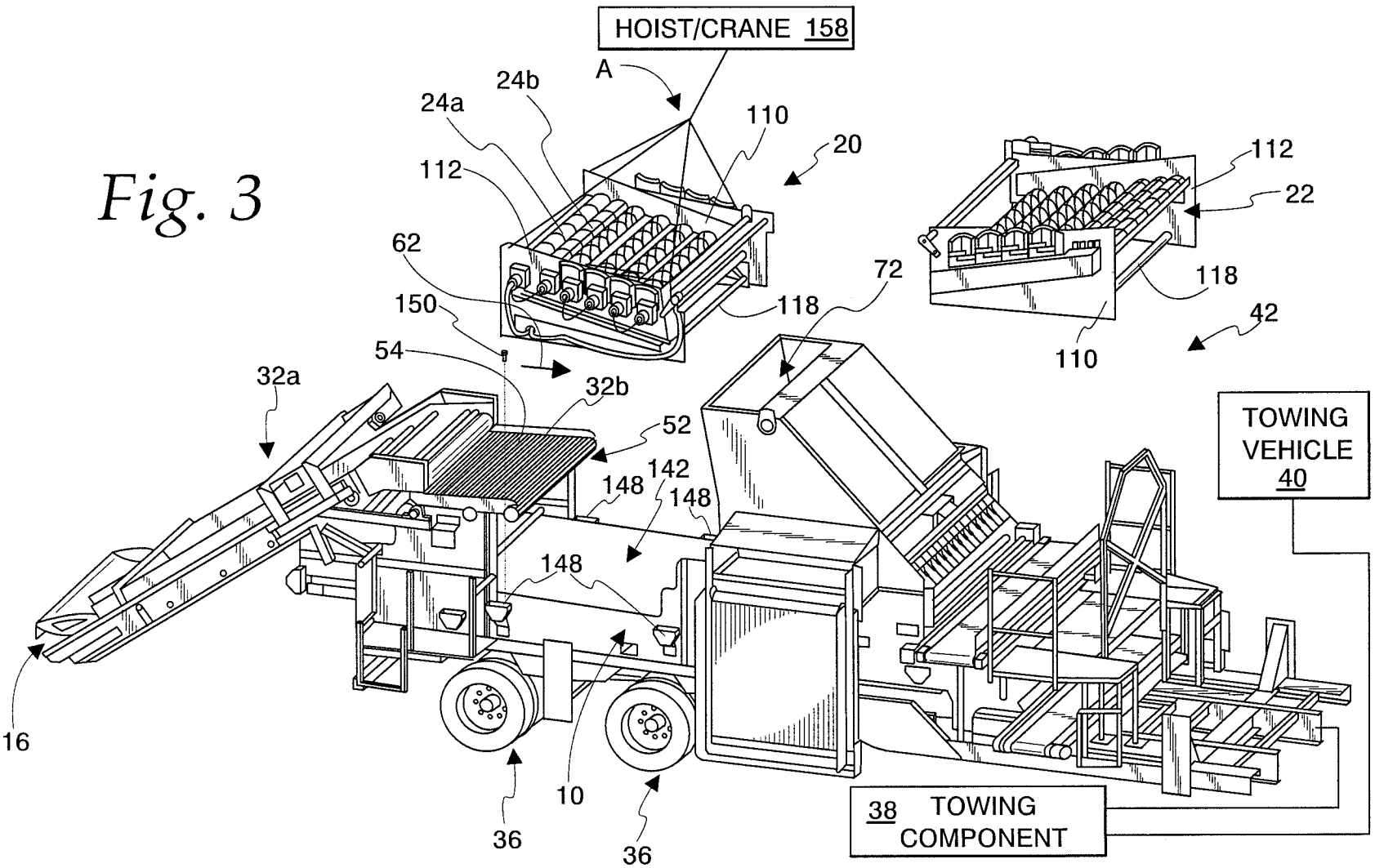
FIG. 3 is an exploded, perspective view of an apparatus for processing usable crop intermixed with debris and incorporating one form of debris separating assembly as shown in FIGS. 1 and 2.
Figure 4:
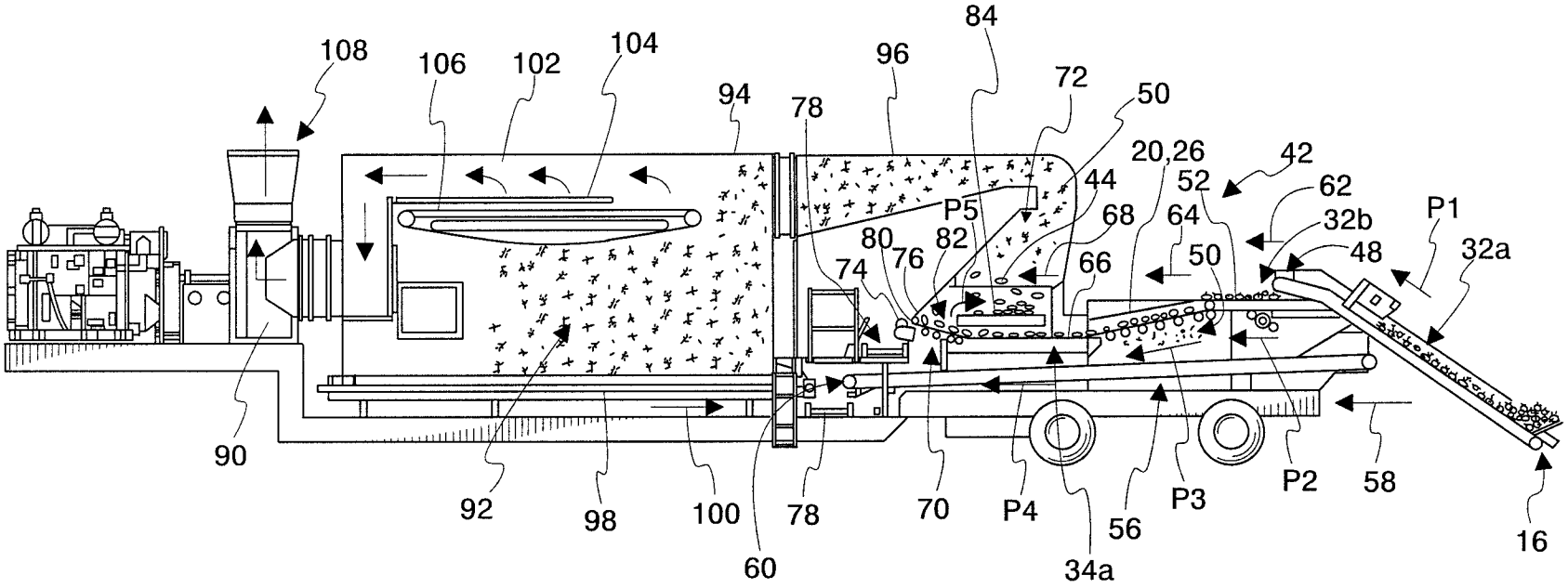
FIG. 4 is a side elevation view of the apparatus in FIG. 3 and partially in cross-section.
Figure 6:
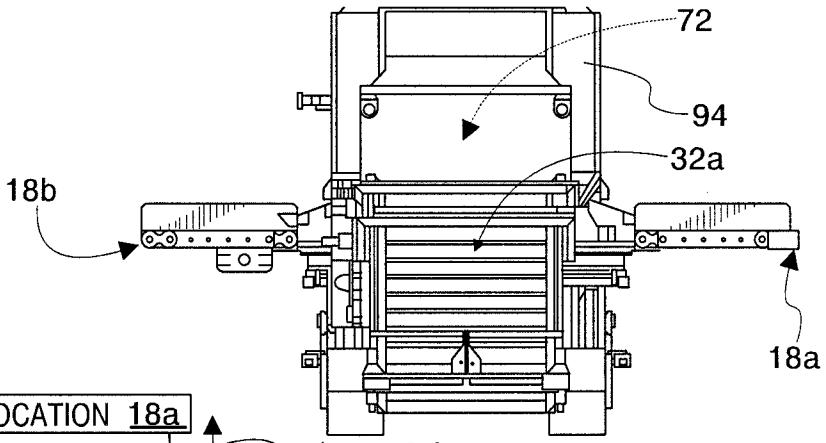
FIG. 6 is a rear elevation view of the apparatus shown in FIGS. 3-5.
Figure 7:
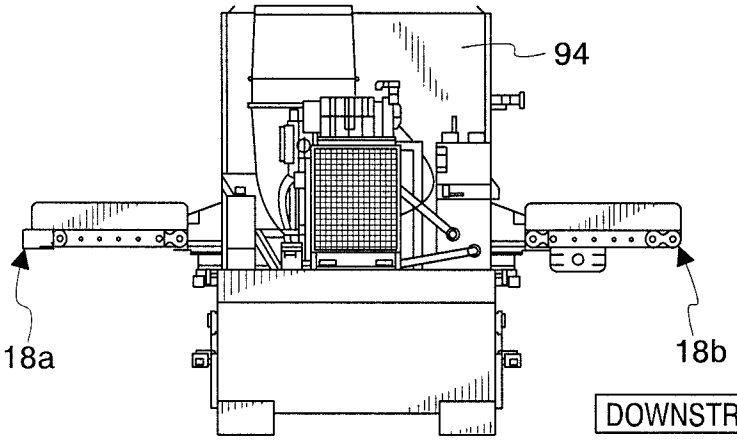
FIG. 7 is a front elevation view of the apparatus shown in FIGS. 3-6.

While the operatively connected first or second debris separating assembly 20, 26 may directly convey the usable crop intermixed with debris between the upstream and downstream locations 16, 18, as indicated by the dotted lines in FIG. 1, as further shown schematically in FIG. 2, the conveying system 14 may have at least a first conveying section 32 upstream of the operatively connected first or second debris separating assembly 20, 26, and a second conveying section 34 downstream of the operatively connected first or second debris separating assembly 20, 26. The first conveying section 32 is configured to convey usable crop intermixed with debris in a portion of the processing path to the operatively connected first or second debris separating assembly 20, 26. The second conveying section 34 is configured to convey usable crop in a portion of the processing path away from the operatively connected first or second debris separating assembly 20, 26.

The schematic depiction of the components in FIGS. 1 and 2 is intended to encompass the specific corresponding components, described below, and virtually an unlimited number of variations thereof and their interaction. The specific forms for those components and how they interact, as described hereinbelow, are representative in nature only and should not be viewed as limiting.

The conveying system 14 may be incorporated into an overall system as shown in U.S. Pat. No. 9,730,380, the disclosure of which is incorporated herein by reference. In U.S. Pat. No. 9,730,380, a "unit" at 80 is incorporated that is commonly referred to as a cleaning table with the capability of conveying usable crop and debris intermixed therewith over a portion of a processing path for the usable crop and for causing separation of the intermixed debris from the advancing usable crop as it is advanced towards its ultimate downstream location.

The entire apparatus shown in U.S. Pat. No. 9,730,380, which incorporates a system as shown at 10 herein, has numerous other components that contribute to crop processing and handling but are not critical to understanding the present invention. Since the structure and operation of the peripheral components are disclosed in detail in U.S. Pat. No. 9,730,380, the same level of detail need not be set forth herein. Rather, a specific form of the overall apparatus will be described hereinbelow, with emphasis only on critical portions thereof that are modified to accommodate the system 10.

The apparatus 10, as shown in FIGS. 3-17 and incorporating the system 10, has the same basic operation as the apparatus shown in U.S. Pat. No. 9,730,380. While not a requirement, the frame 12 is mounted on a wheeled chassis 36 with a towing component 38 thereon that can be engaged by a towing vehicle 40 through which the entire apparatus 42 can be transported to different processing locations, which may be at the same or different sites.

Figure 5:
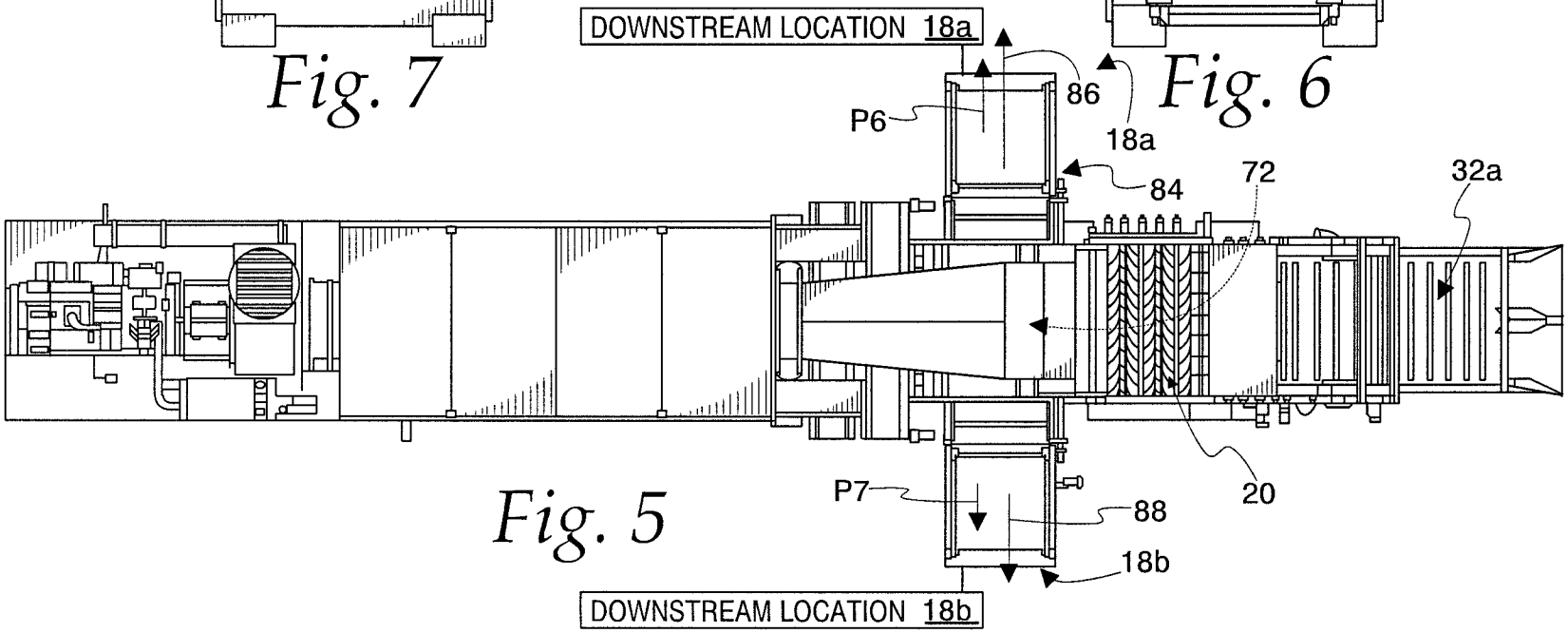
FIG. 5 is a plan view of the apparatus shown in FIGS. 3 and 4.
Figure 9:
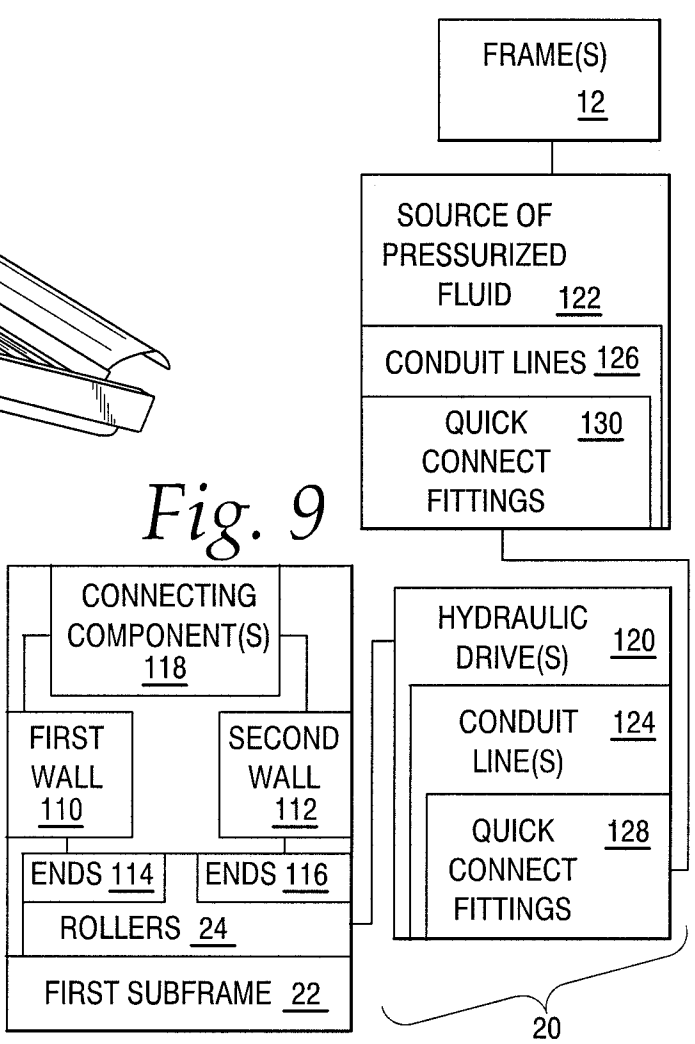
FIG. 9 is a schematic representation of a debris separating assembly, according to the invention, as shown in one exemplary form in FIGS. 3-8, and in relationship to a source of pressurized fluid on the mounting frame through which rollers on the debris separating assembly are operated.

The depicted processing apparatus 42 has two upstream conveying sections 32*a*, 32*b*. The conveying section 32*a* is depicted in FIG. 5 of U.S. Pat. No. 9,730,380, and defines an elevator conveyor for usable crop intermixed with debris from the upstream location 16 at which the usable crop and intermixed debris are first engaged by the processing apparatus 42. For purposes of simplifying explanation herein, the exemplary crop to be processed will be considered to be potatoes 44. The usable crop which the apparatus 36 is capable of processing is not so limited.

Figure 8:
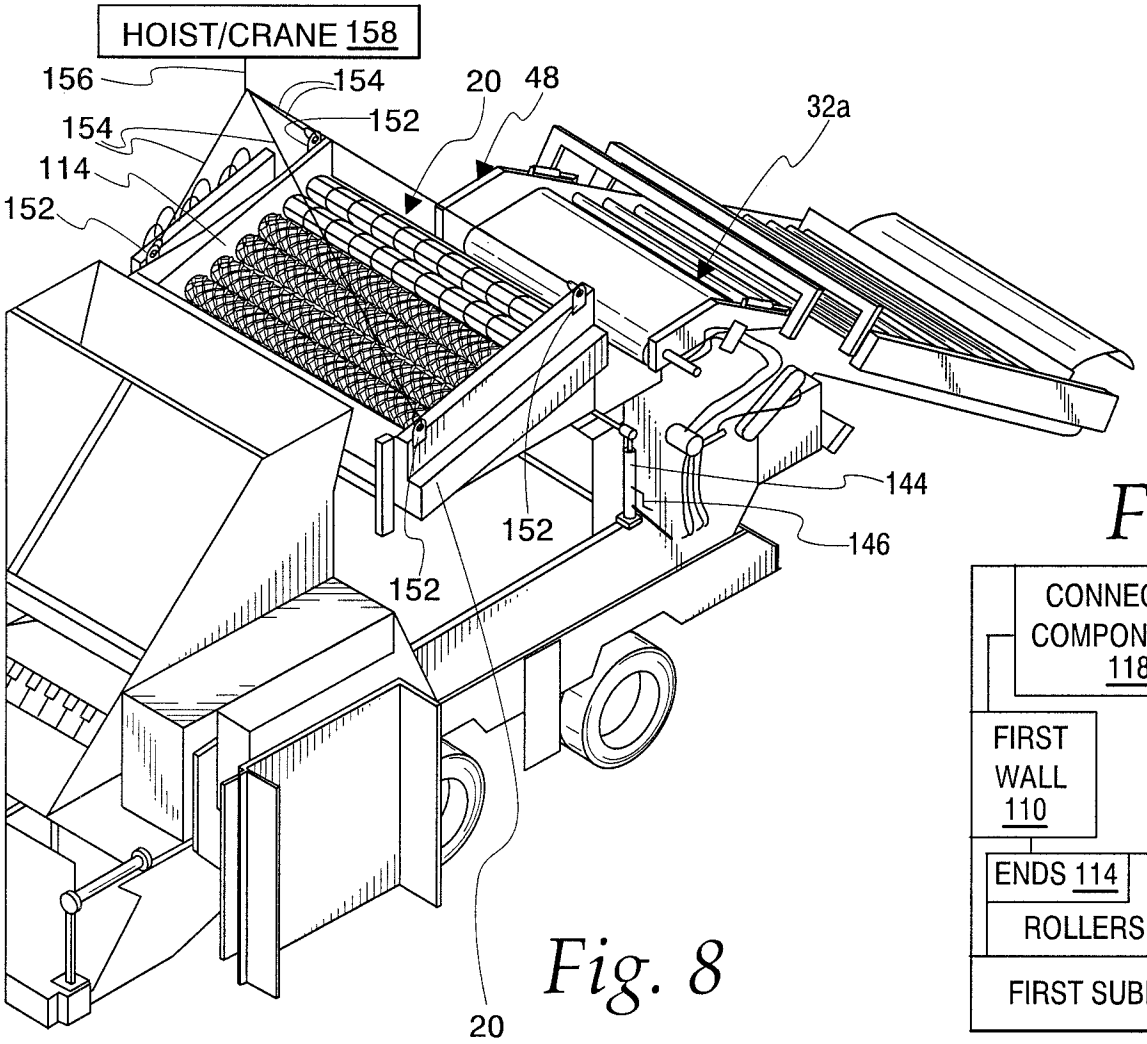
FIG. 8 is a fragmentary, perspective view of the rear region of the apparatus shown in FIGS. 3-7 and with a hoist/crane maneuvering a debris separating assembly in relationship to a receiving frame.
Figure 12:
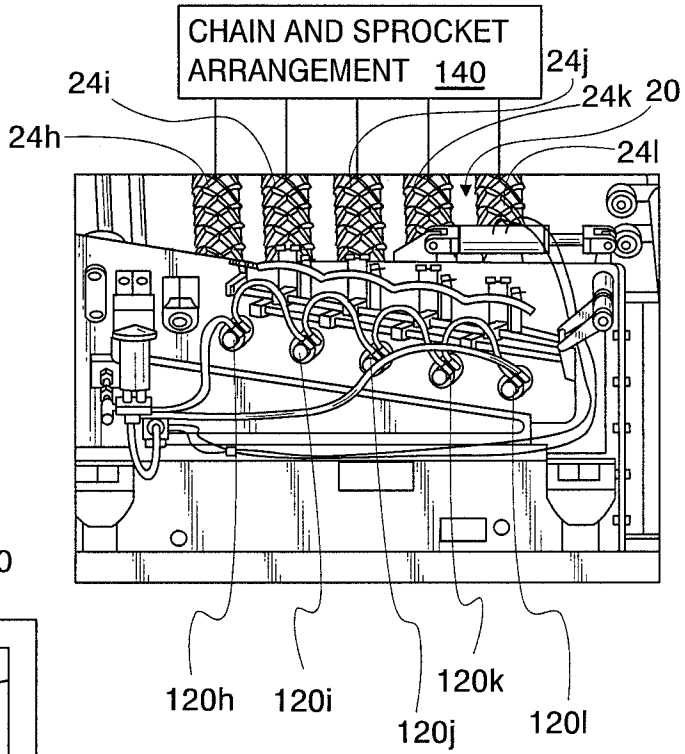
FIG. 12 is a fragmentary, perspective view of the debris separating assembly in FIGS. 10 and 11 and taken from the side opposite that in FIG. 10.
Figure 11:
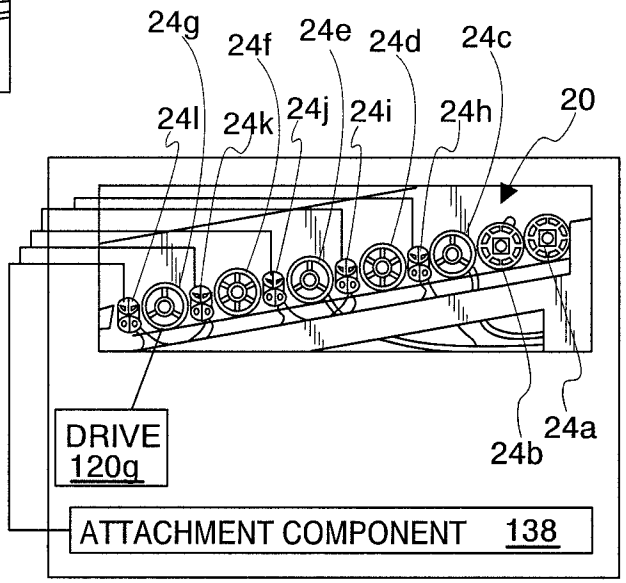
FIG. 11 is a fragmentary, side elevation view of the debris separating assembly in FIG. 10.
Figure 10:
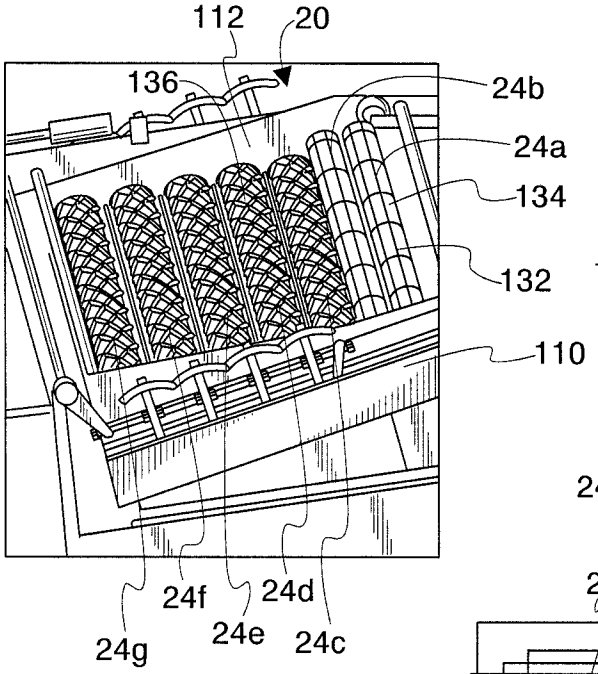
FIG. 10 is a fragmentary, perspective view of the debris separating assembly as shown in FIGS. 3-8.

The potatoes 44 enter the elevator conveyor 32*a* and are laterally spread by a divider. At a downstream end 48 of the elevator conveyor 32*a*, the potatoes 44 and intermixed debris 50 discharge to the section 32*b* which is depicted in FIG. 8 of U.S. Pat. No. 9,730,380 and consists of an endless conveyor 52 defined by parallel, rubber-coated rods 54 that are spaced to allow loose soil and debris to fall therebetween and deposit on an underlying endless conveyor 56, which transports the accumulated discharge in the direction of the arrow 58. From a discharge end 60 of the conveyor 56, the accumulated discharge is staged or otherwise handled.

The conveying section 32*b* conveys the usable crop/potatoes in the direction of the arrow 62 to the operatively connected first or second debris separating assembly 20, 26, which correspond to the cleaning table at 80 in U.S. Pat. No. 9,730,380, will be described in greater detail below. It suffices to say that the operatively connected first or second debris separating assembly 20, 26 conveys the potatoes and any adhered debris in the direction of the arrow 64 and causes additional debris to fall under its weight to the conveyor 56 while residing at the separating assembly 20, 26. This debris may be in the form of excess dirt, clods, vines, and other trash.

A conveying section 34*a* is provided downstream of the operatively connected first or second debris separating assembly 20, 26. This conveying section 34*a* has an endless conveyor 66 that advances the potatoes and intermixed debris in the direction of the arrow 68. The downstream end of the conveyor section 34*a* has an upwardly inclined portion 70 and a reconfiguration capability as described in detail in U.S. Pat. No. 9,730,380, in column 7 thereof. While not critical to the present invention, this construction controls the speed, angle, and distance at which potatoes are fed into a vacuum chamber 72. A breakaway feature allows large rocks 74 to pass under a crossbar 76 onto a conveyor 78 which additionally accepts the accumulated debris discharging from the conveyor 56. The conveyor 78 directs the rocks and other debris to an appropriate point of use as for staging or other suitable handling or disposal.

The controlled position of the discharge end 80 of the conveyor 66 aids in adjusting air velocity at an intake 82 to the vacuum chamber 72. A low pressure volume in the vacuum chamber 72 causes the potatoes 44 to be lifted off of the conveyor 66 and to be deposited on a separate conveyor 84 which is capable of directing the potatoes in laterally opposite directions, as indicated by the arrows 86, 88, to appropriate collection locations or to further structure that effects conveyance thereof.

The entire processing path for the potatoes consists of serially arranged, separate path portions with the conveyor section 32*a* advancing the potatoes in a path portion P1, the conveyor section 32*b* advancing the potatoes in a path portion P2, the operatively connected first or second debris separating assembly 20, 26 advancing the potatoes in a path portion P3, the conveyor 66 advancing the potatoes in a path portion P4, the low pressure volume in the vacuum chamber 72 causing the potatoes 44 to move in a path portion P5 between the conveyor 66 and the conveyor 84, which directs the potatoes alternatively in path portions P6 or P7 to alternative downstream locations 18*a*, 18*b*.

An exhaust fan 90 creates low pressure in an air volume 92 within a collection container 94, which volume 92 is in communication with the vacuum chamber 72 through a conduit 96 such that the low pressure in the vacuum chamber 72 is created by the same exhaust fan 90.

High velocity air flow within the vacuum chamber 72 causes the debris 50 to rise from the conveyor 84 and ultimately to be deposited under its weight upon a continuous conveyor component 98 which advances the debris in the direction of the arrow 100 for delivery to the conveyor 78.

The majority of the debris drawn by the exhaust fan 90 falls under its own weight to the conveyor 98. The conveyor 98 has a drag chain construction to continuously draw settled debris to the conveyor 78. Any rising lightweight debris tending to migrate into a return conduit portion 102 is intercepted by a debris screen 104. An endless sweeper chain 106 under the debris screen 104 removes large debris buildup on the screen so that it does not interrupt a constant airflow.

Clean air discharges preferably at a location at 108, which is above the height at which workers tending to the operation of the apparatus maneuver to control noise generation in the work area.

In one preferred form, each of the debris separating assemblies 20, 26 is in the form of a self-contained module that can be operatively connected to the at least one frame 12 and separated therefrom as a unit. As one exemplary form of module, for the exemplary first debris separating assembly 20, as shown schematically in FIG. 9, the first subframe 22 has first and second walls 110, 112 that support opposite ends 114, 116 of the rollers 24. The first and second walls 110, 112 are maintained in a desired relationship by at least one connecting component 118, and more preferably by a plurality of such components 118, whereby the first and second walls 110, 112 and connecting components 118 define a fixed, unitary frame construction that supports the rollers 24.

The debris separating assembly 20 has at least one drive 120. In a preferred form, the drives 120 are hydraulically operated, but this is not a requirement. One hydraulic drive 120 may drive multiple rollers. It is contemplated that a plurality, or all, of the rollers 24 may be provided with their own drive 120.

The at least one frame 12 has a source of pressurized fluid 122 to create an hydraulic circuit through which the drives 120 on the first debris separating assembly 20 are operated.

The hydraulic drives 120 and source of pressurized fluid 122 respectively have conduit lines 124, 126 through which hydraulic fluid is communicated between the source of pressurized fluid 122 and the drives 120. In a preferred form, quick connect fittings 128, 130 are provided on the conduit lines 124, 126, respectively, to facilitate operative connection of the selected debris separating assembly, and in this exemplary depiction the debris separating assembly 20.

As noted above, the generic depiction of the first debris separating assembly 20, and its relationship with the source of pressurized fluid 122 on the at least one frame 12, while described with respect to the first debris separating assembly 20, is intended to be generic to the second debris separating assembly 26, and any additional debris separating assemblies that might be interchangeably operatively connected to the frame 10. The generic showing contemplates that there might be significant differences in the construction of the interchangeable debris separating assemblies so long as they have the common modular construction that allows interchangeability.

Referring to FIGS. 3, 8, and 10-12, more specific details of the first debris separating assembly 20 are shown. The subframe 22 consists of flat first and second walls 110, 112 fixedly interconnected by rigid, elongate connecting components 118.

The rollers 24 are configured to effect an aggressive debris removal from the potatoes 44. The potatoes 44 and debris 50 enter the first debris separating assembly 20 from the conveying section 32*b* over a pair of transition rollers 24*a*, 24*b*. The transition rollers 24*a*, 24*b* each has circumferentially spaced, axially extending ribs 132 at a respective peripheral outer surface 134.

Downstream of the transition rollers 24*a*, 24*b* are five fluted rollers 24*c*, 24*d*, 24*e*, 24*f*, 24*g*. The fluted rollers 24*c*-24*g* are preferably made from urethane, with the flutes 136 spiraling in crossing opposite directions. This provides an augering effect in both operating directions for the rollers 24*c*-24*g*. The fluted rollers 24*c*-24*g* rotate in one direction to advance the potatoes 44 in the processing path.

Between the fluted rollers 24*c*-24*g* are smooth rollers 24*h*, 24*i*, 24*j*, 24*k*, 24*l* that are smaller in diameter than the fluted rollers 24*c*-24*g*. The smooth rollers 24*c*-24*g* may be made from steel or rubber and can rotate in opposite directions. This allows the fluted rollers 24*c*-24*g* and smooth rollers

24*h*-24*l* to function as fingers that grab and pull long, stringy debris 50 from the potatoes 44. It also allows the fluted rollers 24*c*-24*g* to break dirt clods between adjacent rollers.

The smooth rollers 24*h*-24*l* may be adjustable away from the fluted rollers 24*c*-24*g* either individually or together, which is facilitated by use of an attachment component 138. By increasing the distance, larger pieces of debris can be removed. Further, by raising one or more of the smooth cylinders 24*h*-24*l*, a stall situation can be created, allowing the fluted rollers 24*c*-24*g* to more effectively grab the debris 50.

In this embodiment, one of the fluted rollers 24*g* has an associated drive 120*g* and is connected to the remaining fluted rollers 24*h*-24*k* through a chain and sprocket arrangement as shown at 140.

The smooth rollers 24*h*-24I each has its own drive 120*h*-1201, successively. Hydraulic fluid is communicated to the smooth rollers 24*h*-24*l* in series.

The fluted rollers 24*c*-24*g* are independently speed controlled and can operate in reverse directions. The smooth rollers 24*h*-24*l* are also independently speed controlled.

Rotating action agitates the potatoes and gently moves the same in the processing path for ultimate discharge to the conveyor 66.

All of the rollers 24 are rotated around parallel axes crossed substantially orthogonally by the processing path.

The frame 12 defines a discrete receptacle 142 that is nominally matched to the circumscribing shape that contains the volume of the first debris separating assembly 20. The receptacle 142 has a vertical depth selected so that the operatively connected first debris separating assembly 20 is situated to assume the FIG. 4 relationship with the immediately upstream and downstream conveying sections 32*b*, 34*a*.

As shown in FIG. 8, to facilitate operative connection and disconnection of the debris separating assemblies, the downstream end 48 of the conveyor section 32*a* may be raised through a jack assembly 144 on the frame 12, The jack assembly 144 may be operated manually by an external actuator 146. This provides additional clearance that may avoid interference between the debris separating assembly that is being maneuvered relative to the frame 12.

The frame 12 has a plurality of discrete, spaced, mounting pads 148, in this case four in number, each configured to bear upon a part of the operatively connected first or second debris separating assembly 20, 26. As depicted, the mounting pads 148 are shown to bear two each on each of the walls 110, 112 of the exemplary subframe 22. Releasable fasteners 150 are used to secure the operatively connected debris separating assembly 20, 26, as depicted directly to the mounting pads 148.

To facilitate handling of the debris separating assembly 20, lifting fittings 152 are provided on the subframe 22. As depicted, four such lifting fittings 152 are provided, each in the form of a lifting loop which allows engagement by a lifting cable. With the arrangement shown, four cable lengths 154 can branch from a primary lifting length 156 which can be engaged by a hoist or crane 158 and used to individually handle each of the subframes on the respective debris separating assemblies 20, 26. The lifting fittings 152 can be situated so that the debris separating assembly being handled can be suspended in substantially its final orientation relative to the frame 12 so that it can be directed vertically downwardly against the mounting pads 148 and raised upwardly therefrom without interfering with other components on the frame 12.

The different debris separating assemblies can have virtually an unlimited number of different constructions. The differences may be in the number of rollers, how the rollers are driven, difference in the peripheral outer surfaces of the rollers, different numbers of rollers, different numbers of rollers driven, different combinations of the same rollers, etc. A desirable feature is that each different configuration that is interchangeable has the ability to function differently in terms of how it handles soil types, debris, crop type, etc. Some representative examples of existing alternative configurations are described below. That being said, the inventive concepts can be used to replace debris separating assemblies, that are worn or malfunctioning, with an identical unit.

Figure 15:
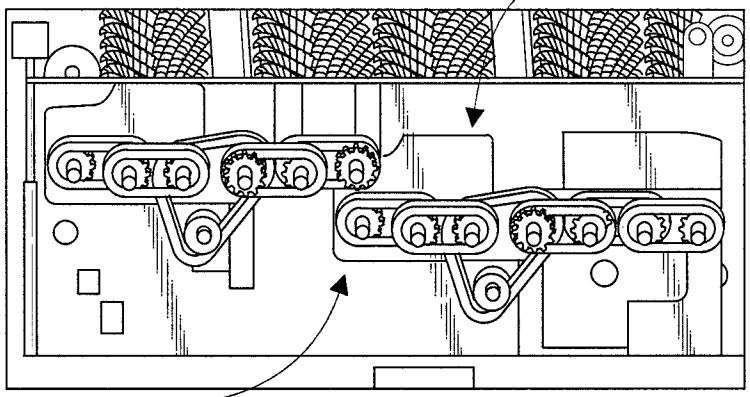
FIG. 15 is a fragmentary, perspective view of the debris separating assembly taken from the side opposite that in FIG. 13.
Figure 14:
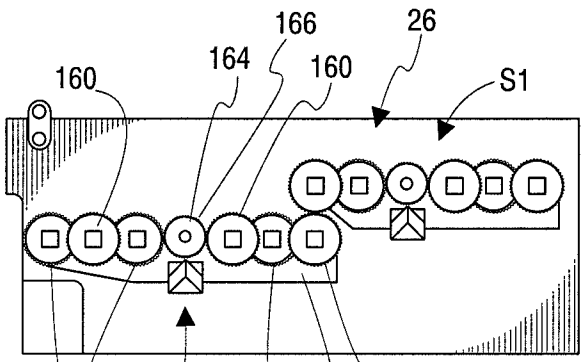
FIG. 14 is a fragmentary, side elevation view of the debris separating assembly in FIG. 13.
Figure 13:
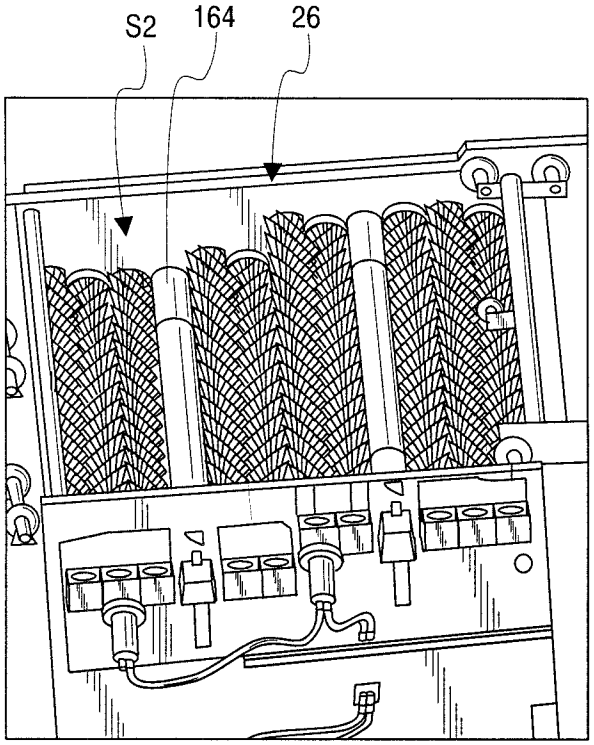
FIG. 13 is a view as in FIG. 10 of another form of debris separating assembly according to the invention.

In FIGS. 13-15, a design is shown that is referred to commercially as a "double stone table".

The debris separating assembly 26 shown in FIGS. 13-15 has a stepped arrangement of rollers, as viewed from the side in FIG. 14. The first combination of rollers makes up an upper step S1, with the same basic arrangement of rollers making up a lower step S2. Since the roller combination in the steps S1, S2 are essentially the same, the discussion herein will be limited to the exemplary lower step S2.

There are three different types of rollers utilized in the step S2—roller 160 that utilizes a "star" configuration with thirteen fingers, roller 162 that utilizes a star configuration with seven fingers, and a roller 164 that has a smooth outer peripheral surface 166. The details of this configuration are described in U.S. Pat. No. 9,730,380.

Briefly, the rollers 160 are made with a series of thirteen finger stars, with the rollers 162 using seven finger stars. The precise number of fingers is not critical. The roller 164 is made preferably from steel.

Many different constructions, and combinations, of star and rollers can be used. As depicted, the rollers 160, 162 alternate, with the roller 164 residing between the middle rollers 160, 162. The stars on adjacent rollers are staggered so that the stars on each inside roller lie between stars on each adjacent roller.

The upstream combination of rollers 160, 162 is connected to a plate 168 to be movable therethrough together in a linear path to vary a gap between the downstream-most roller 160 and the smooth roller 164. The smooth roller 164 can also be moved vertically as to place the same slightly above the other roller surfaces to create a stall effect. Flat rock will tend to stall at the steel roller as the following star rotation tends to tip the rock downward so that it falls through the debris separating assembly 26.

In this embodiment, one of the rollers 160, 162 is rotated by an hydraulic drive, with the remaining rollers 160, 162, 164 connected by a chain-and-sprocket arrangement, as shown generally at 170 in FIG. 15.

Rotating action agitates the potatoes 44 and gently moves them to the downstream end of the debris separating assembly 26.

The rollers in the separate steps S1, S2 are controlled separately. This allows the debris separating assembly 26 to function at two different variable speeds for increased agitation.

It is possible to reverse the rotation of the rollers 160, 162 to facilitate cleaning, as when wet and sticky conditions are encountered.

Figure 17:
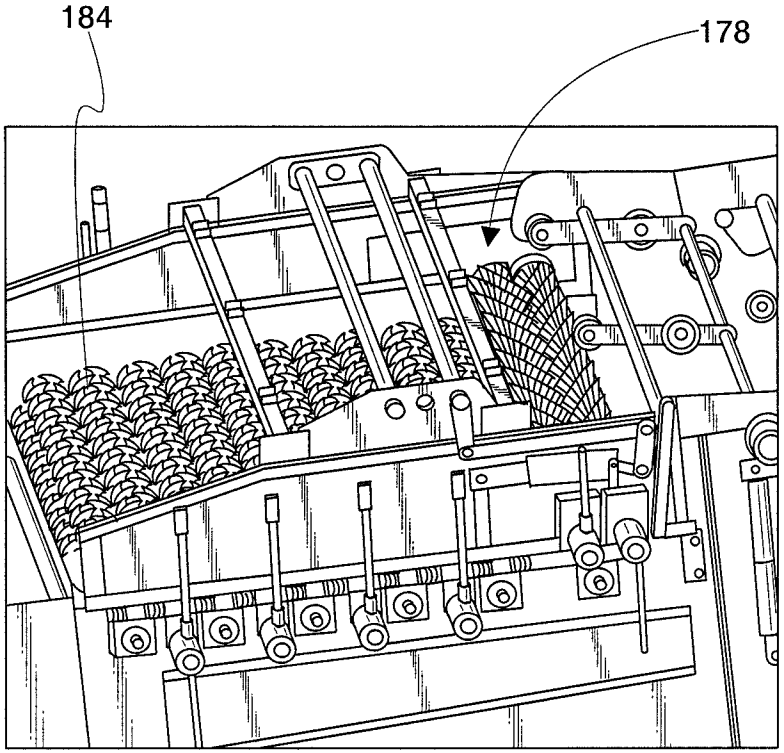
FIGS. 16 and 17 are views similar to those in FIGS. 10 and 13 and showing two alternative configurations of debris separating assemblies, according to the invention.
Figure 16:
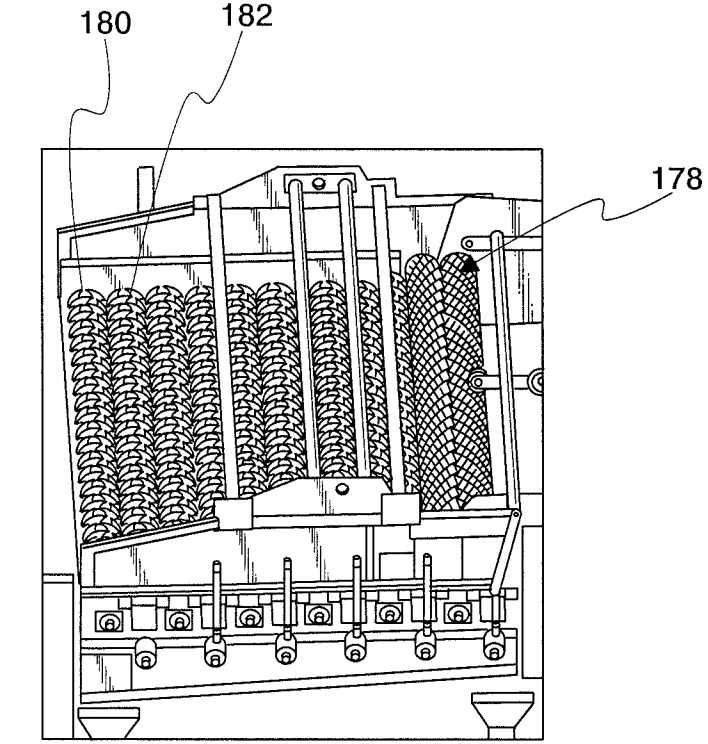

FIGS. 16 and 17 show two additional configurations for debris separating assemblies 172, 174, respectively. Both assemblies 172, 174 utilize rollers with "star shafts" that intermesh and have different combinations and numbers of stars.

Both utilize the same star roller combination at an upstream end as shown at 178. This entry roller combination spreads and effects a controlled drop of potatoes 44 and debris to the primary separating surface.

The separating system 172 utilizes alternating rollers 180, 182, respectively with stars having thirteen and seven fingers.

The separating system 174 utilizes the same roller configurations with five finger star rollers 184 with a wide hub arrangement. The fingers on each roller 184 are enmeshed between fingers on adjacent rollers.

In both separating system, the individual fingered "stars" are slidable on their respective roller shafts.

The roller shafts are mounted to slides at each end with compression springs provided therebetween. The springs can be compressed or extended, allowing the star shafts to open and close or slide linearly back and forth. The open and close action creates more or less open area between the individual stars. This allows additional material to fall through the table.

Each star shaft is rotated by an hydraulic drive. The rotating action agitates the product and gently moves the potatoes 44 to the downstream end of a respective separating assembly.

Alternating groups of roller shafts may be driven together and controlled separately from the second group of roller shafts. This allows the rollers to function at two different variable speeds for increased agitation. Both groups of roller shafts have independently variable speed control.

Reverse rotation of the shafts is permitted to clear the table as commonly required when operating occurs in wet, sticky conditions.

Figure 18:
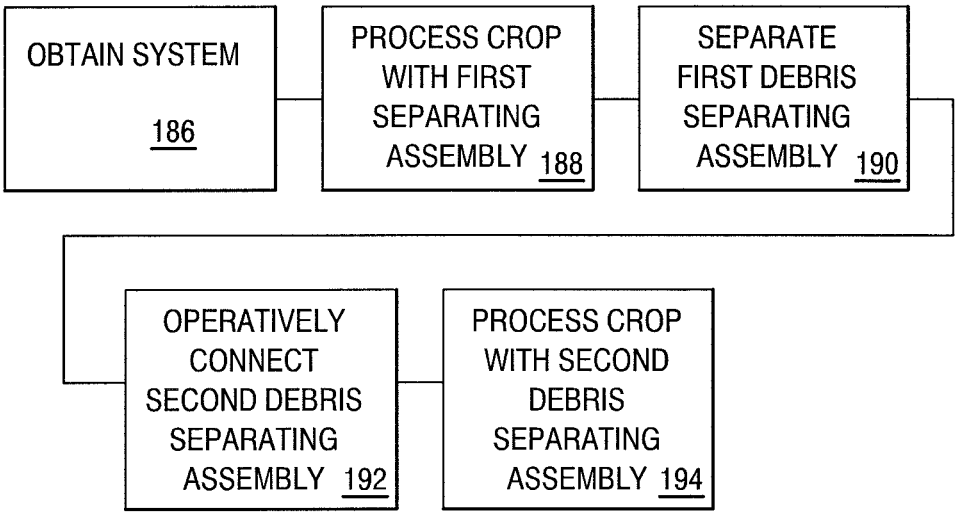
FIG. 18 is a flow diagram representation of a method of processing usable crop intermixed with debris, according to the invention.

With the above structure, a method of processing usable crop intermixed with debris can be carried out as shown in flow diagram form in FIG. 18.

As shown at block 186, a system as described above is obtained.

As shown at block 188, crop with intermixed debris is processed with the first separating assembly operatively connected.

As shown at block 190, the first debris separating assembly is separated from the frame.

As shown at block 192, the second debris separating assembly is operatively connected to the frame.

As shown at block 194, crop is processed with the second debris separating assembly operatively connected.

In maneuvering the first and second crop processing assemblies—by operatively connecting to, or separating the same from, a frame—a hoist/crane can be used.

The invention contemplates that the interchanging of the different crop processing assemblies may result after an analysis of conditions of the soil in which the crop to be processed is planted. This analysis may occur in the field where the crop is processed.

In the event that hydraulic powering of rollers is performed, preferably all hydraulic connections made between the frame 14 and the various crop processing assemblies can be made using quick connect fittings whereby no tools may be required to operatively connect and disconnect the crop processing assemblies.

The foregoing disclosure of specific embodiments is intended to be illustrative of the broad concepts comprehended by the invention.

The invention claimed is:

1. A system for processing usable crop intermixed with debris, the system comprising:

at least one frame;

a conveying system on the at least one frame configured to convey usable crop in a processing path between upstream and downstream locations, the conveying system comprising a first debris separating assembly with a first subframe having a plurality of cooperating rollers therein that are configured to: a) engage usable crop intermixed with debris traveling between the upstream and downstream locations; and b) cooperate to cause separation of debris from the usable crop, the conveying system comprising a second debris separating assembly with a second subframe having a plurality of cooperating rollers thereon that are configured to: a) engage usable crop intermixed with debris traveling between the upstream and downstream locations; and b) cooperate to cause separation of debris from the usable crop, the first debris separating assembly having a configuration different than a configuration of the second debris separating assembly, the at least one frame and first and second debris separating assemblies configured so that the first and second debris separating assemblies can be separately operatively connected, one in place of the other, on the at least one frame, wherein the at least one frame defines a discrete upwardly opening receptacle into which the first and second subframes are selectively directed to thereby cause the selected debris separating assembly to be operatively connected on the at least one frame, each of the first and second subframes and at least one frame configured so that each of the first and second subframes can be moved selectively in a vertical path: a) upwardly, from a position within the receptacle wherein the selected debris separating assembly is operatively connected on the at least one frame, to out of the receptacle to become separated from the at least one frame; and b) downwardly from a position spaced vertically above the at least one frame to within the receptacle to thereby cause the selected debris separating assembly to be operatively connected on the at least one frame.

2. The system for processing usable crop intermixed with debris according to claim 1 wherein the conveying system comprises at least a first conveying section upstream of the operatively connected first or second debris separating assembly and a second conveying section downstream of the operatively connected first or second debris separating assembly, the first conveying section configured to convey usable crop intermixed with debris in a portion of the processing path to the operatively connected first or second debris separating assembly, the second conveying section configured to convey usable crop in a portion of the processing path away from the operatively connected first or second debris separating assembly.

3. The system for processing usable crop intermixed with debris according to claim 1 wherein at least one of the rollers in the plurality of cooperating rollers on each of the first and second debris separating assemblies is a driven roller.

4. The system for processing usable crop intermixed with debris according to claim 1 wherein first and second rollers in the plurality of cooperating rollers on each of the first and second debris separating assemblies are each driven rollers.

5. The system for processing usable crop intermixed with debris according to claim 1 wherein a total number of the rollers on the first debris separating assembly is different than a total number of the rollers on the second debris separating assembly.

6. The system for processing usable crop intermixed with debris according to claim 1 wherein the rollers on the first and second debris separating assemblies each has a peripheral outer surface to engage conveying usable crop and a configuration of the peripheral outer surface of one of the rollers on the first debris separating assembly is different than a configuration of the peripheral outer surface of any of the rollers on the second debris separating assembly.

7. The system for processing usable crop intermixed with debris according to claim 1 wherein the discrete receptacle has a vertical depth into which the subframe on the operatively connected first or second debris separating assembly is placed.

8. The system for processing usable crop intermixed with debris according to claim 1 wherein the at least one frame comprises a plurality of discrete, spaced mounting pads each configured to bear upon a part of the subframe on the operatively connected first or second debris separating assembly.

9. The system for processing usable crop intermixed with debris according to claim 1 wherein each of the first and second subframes comprises first and second walls at which opposite ends of the rollers on the respective subframe are supported, the rollers on each of the first and second operatively connected debris separating assemblies having axes that are transverse to the processing path.

10. The system for processing usable crop intermixed with debris according to claim 9 wherein the first and second walls on each of the first and second subframes are spanned by a plurality of connecting components whereby the first and second walls and connecting components on each of the first and second subframes define a fixed, unitary construction that supports respective rollers.

11. The system for processing usable crop intermixed with debris according to claim 8 further comprising a plurality of releasable fasteners through which the operatively connected first or second debris separating assembly is secured to the at least one frame.

12. The system for processing usable crop intermixed with debris according to claim 1 wherein the system comprises a drive for at least one of the rollers on the operatively connected first or second debris separating assembly.

13. The system for processing usable crop intermixed with debris according to claim 1 wherein there is a hydraulic drive on each of the first and second debris separating assemblies for at least one of the rollers on a respective debris separating assembly and a source of pressurized hydraulic fluid on the at least one frame for operating the hydraulic drive on the operatively connected first or second debris separating assembly.

14. The system for processing usable crop intermixed with debris according to claim 13 wherein the hydraulic fluid is communicated from the source of pressurized hydraulic fluid to the hydraulic drives through conduit lines and there are quick connect fittings on the conduit lines connecting between the source of pressurized hydraulic fluid and the hydraulic drives on the first and second debris separating assemblies to facilitate interchanging of the first and second debris separating assemblies.

15. The system for processing usable crop intermixed with debris according to claim 1 wherein there are a plurality of lifting fittings on each of the first and second subframes to facilitate lifting and handling of each of the first and second subframes.

16. A method of processing usable crop intermixed with debris, the method comprising the steps of:

obtaining the system of claim 1 wherein the first and second debris separating assemblies have different configurations selected to process usable crop intermixed with debris with different types or conditions of soil in which the usable crop is planted and/or different usable crop;

with the first debris separating assembly operatively connected, unearthing the usable crop from the soil and processing the usable crop and intermixed debris by conveying the usable crop and intermixed debris in the processing path including to the first debris separating assembly at which intermixed debris is separated from the usable crop;

separating the first debris separating assembly from the at least one frame;

operatively connecting the second debris separating assembly; and with the second debris separating assembly operatively connected, unearthing additional usable crop from the soil and processing the additional usable crop and intermixed debris by conveying the usable crop and intermixed debris in the processing path including to the second debris separating assembly at which intermixed debris is separated from the usable crop.

17. The method of processing usable crop intermixed with debris according to claim 16 further comprising the step of obtaining one of a hoist or a crane and using the hoist or crane to vertically lift the operatively connected first debris separating assembly as a unit away from the at least one frame and to lower the second debris separating assembly as a unit to against the at least one frame to a position wherein the second debris separating assembly can be operatively connected to the at least one frame.

18. The method of processing usable crop intermixed with debris according to claim 16 further comprising the step of analyzing a condition of the soil in which the usable crop is planted and selecting one of the first and second debris separating assemblies that is configured to better process the usable crop intermixed with debris than the other of the first and second debris separating assemblies.

19. The method of processing usable crop intermixed with debris according to claim 16 wherein the step of operatively connecting the second debris separating assembly comprises securing the second debris separating assembly to the at least one frame using threaded fasteners.

20. The method of processing usable crop intermixed with debris according to claim 16 wherein a hydraulic drive is provided on each of the first and second debris separating assemblies for at least one of the rollers on a respective debris separating assembly and a source of pressurized hydraulic fluid is provided on the at least one frame, where the hydraulic fluid is communicated to the hydraulic drive through conduit lines and further comprising the steps using quick connect fittings on the conduit lines to facilitate separation of the operatively connected first and second debris separating assemblies from the at least one frame and operative connection of each selected first and second debris separating assembly to the at least one frame.

* * * * *